United States Patent [19]

McPhillips

[11] Patent Number: 4,718,940

[45] Date of Patent: Jan. 12, 1988

[54] METHOD OF MANUFACTURING ALLOY FOR USE IN FABRICATING METAL PARTS

[76] Inventor: Kerry A. McPhillips, 3780 Olive Ave., Long Beach, Calif. 90807

[21] Appl. No.: 859,616

[22] Filed: May 5, 1986

[51] Int. Cl.[4] ..... C21C 7/10

[52] U.S. Cl. ..... 75/10.18; 75/49

[58] Field of Search ..... 75/49, 10.18

[56] References Cited

U.S. PATENT DOCUMENTS

| | | | |
|---|---|---|---|
| 3,305,923 | 2/1967 | Zimmer | 29/528 |
| 3,764,297 | 10/1973 | Coad | 75/10.64 |
| 4,105,438 | 8/1978 | Sherwood | 75/49 |
| 4,616,808 | 10/1986 | Nikolov | 75/49 |

*Primary Examiner*—Peter D. Rosenberg

*Attorney, Agent, or Firm*—Charles H. Thomas

[57] ABSTRACT

A method is provided for producing a quantity of high grade metal alloy containing reactive elements, such as aluminum and titanium in a nickel, cobalt or iron base. According to the method of the invention a master heat of ingot containing reactive elements, such as aluminum and titanium in a nickel, cobalt or iron base is formed by some vacuum melting process, such as by vacuum-induction melting. A second, larger master heat of ingot of air-melting grade material is formed, as by argon oxygen decarburization with no reactive elements present. The two ingots are mechanically joined together to form one ingot which is subsequently remelted in the investment casting process. The resulting blend produces a standard alloy which means the metallurgical specifications for metal used in the investment casting of gas turbine components for use in aircraft, and components for turbochargers for use in internal combustion powerplants.

13 Claims, No Drawings

METHOD OF MANUFACTURING ALLOY FOR USE IN FABRICATING METAL PARTS

BACKGROUND OF THE INVENTION

1. Field of the Invention

The present invention relates to a process for manufacturing high-grade metal alloys used by the investment casting industry to manufacture critical parts utilized in the "hot stages" of aircraft jet engines as well as turbocharger components for internal combustion engines.

2. Description of the Prior Art

At present, alloys bearing aluminum and titanium in various concentrations are required in the manufacture of certain metal parts which must resist high temperatures and corrosion. Such alloys are employed, for example, in the fabrication of parts for aircraft gas turbine engines. The metallurgical requirements for metals used to construct such parts are so stringent that the metals are termed "superalloys". The definition adopted by the American Society for Metals for a "superalloy" is: "an alloy developed for very high temperature service where relatively high stresses are encountered and where oxidation resistance is frequently required". More titanium is employed where an alloy of greater strength is required, while more aluminum is employed where the resultant alloy is to be highly resistant to oxidation.

Certain components of turbocharger units are currently produced by investment casting. An ingot of the alloy is first manufactured by vacuum processing, such as vacuum-induction melting, and is supplied in ingot form to an investment caster. The ingot is then remelted and cast in a mold to form the desired parts.

The raw materials for the manufacture of superalloys are classified broadly as either vacuum-melting grade or air-melting grade. Vacuum-melting quality material is the highest grade and must be clean, certified free of extraneous elements not tolerated in superalloys, and identified according to specific alloy. Vacuum-melting grade metals are produced by a number of different processing techniques. These processes include vacuum-induction melting, vacuum-arc remelting, electroflux, electron beam melting, and other processes. To date, special processing has been necessary to produce the raw materials of vacuum-melting grade to meet the very stringent specifications for the production of superalloys for critical components in gas turbine engines, as well as many other parts requiring a high degree of service integrity.

In the process of vacuum-induction melting an electric coil surrounds a refractory crucible and electromotive forces are used to heat the metals of the alloy in the crucible. In vacuum-induction melting the quality of the alloy is dictated predominantly by the quality of the raw materials. That is, the raw materials from which the ingot is formed must be of far greater purity than with other types of metallurgical alloy formation since many impurities are not removed during the vacuum-induction melting process.

Air-melting grade raw materials may contain some oxide scale and some detrimental materials which can be removed in air melting. Air melting is used primarily for wrought alloys used for plate, sheet, bar tube, and forging stock or for producing master alloys for subsequent remelting by the vacuum processes. Air-melting grade materials have been recently produced by the process of argon oxygen decarburization. The argon oxygen decarburization (AOD) process utilizes a trunion mounted open mouthed vessel lined with magnesite-chrome or dolomite refractory brick. Oxygen and inert gas (argon or nitrogen) are injected through under-bath tuyeres located in the side wall of the vessel. Heat generation results from the exothermic reaction of the bath components, and no external heat source is employed or required. The molten metal is initially blown with a high ratio of oxygen to inert gas. As the carbon content of the molten material decreases, the ratio of oxygen to inert gas is lowered step-by-step in order to obtain the most favorable thermodynamic condition. The AOD process desulphurizes the molten metal to very low levels and also removes carbon with high efficiency. However, the process also results in the removal of aluminum and titanium. In the manufacture of turbocharger parts, aluminum is essential to render the alloy resistant to oxidation, while titanium is essential in producing a part of sufficient strength. Accordingly, it has heretofore been necessary to manufacture ingot for the production of turbocharger parts by a vacuum melting process, rather than by an AOD process.

The process of producing components from ingots formed by vacuum-induction melting is extremely expensive as compared with the AOD. The process of forming an ingot containing greater than about 0.1% aluminum and titanium must be carried out in a vacuum due to the reactive nature of these elements with air. It has theretofore been possible to form such alloys solely by vacuum-induction melting. Due to the high cost of raw materials, and due to the expense of the vacuum-induction melting process itself, the ingots containing aluminum and titanium which are used by investment casters to produce metal parts are very, very expensive.

SUMMARY OF THE INVENTION

According to the present invention a method has been devised which greatly limits the amount of vacuum-induction melting alloy which must be used to produce parts by investment casting. According to the invention the bulk of the alloy to be utilized in the finished investment cast parts is produced by a process far cheaper than vacuum-induction melting. For example, the bulk of an alloy containing elements such as chromium, molybuenum, boron, columbium cobalt and nickel may be produced by a process such as AOD. According to this technique, a molten alloy is produced by electric arc or air induction and the molten metal is transferred to a decanter through which oxygen, argon, nitrogen, or any combination of these gasses can be blown to remove undesirable impurities. With AOD, the raw material cost is far lower than with vaccum-induction melting, since raw materials of far less purity can be initially utilized due to the fact that the impurities can be removed, unlike vacuum-induction melting.

According to the invention, the alloy raw materials with the exception of reactive elements, such as aluminum and titanium are refined by AOD and cast into ingots. In order to obtain the necessary aluminum and titanium, refined aluminum and titanium are produced in a relatively small quantity in a matrix material, such as nickel, by vacuum-induction melting or the equivalent. The larger, more cheaply produced ingot of less reactive elements, such as nickel, chromium, molybedenum, columbium and carbon produced by AOD, is mechanically joined to the very small ingot of a nickel, aluminum, titanium alloy for provision to the investment caster. The two quantities are joined together to form one ingot and ultimately melted in the investment casting process to form metal parts from alloys containing the appropriate percentages of aluminum and titanium, so that those parts exhibit the desirable characteristics contributed by those elements.

The function of the investment caster is to pour molten metal into a specific mold to produce metal parts which must withstand harsh operating environments and maintain exacting dimensional tolerances. The metals used to form these parts are quite complex in their chemical makeup, and are typically purchased in pre-alloyed ingot form. The investment caster buys the ingot to an industry specification. The investment caster takes the pre-alloyed ingot and melts it down and produces his parts.

It is widely understood in the investment casting industry that additions of aluminum and titanium in investment casting furnaces is detrimental because of the reactive nature of the aluminum and titanium. Consequently, the only accepted method to date of investment casting parts containing significant quantities of aluminum and titanium has been through the use of ingots produced by vacuum-induction melting, or the equivalent.

The present invention represents a considerable improvement over conventional investment casting techniques since the bulk of the ingot material used to cast the finished parts is not produced by the expensive vacuum-induction melting process, but rather is produced by the far cheaper AOD process. Only a small portion of the material used in the investment casting process must be produced by vacuum-induction melting or equivalent. This ingot is comparable in quality to the conventional vacuum induction ingot.

With the method of the invention, parts can be produced by investment casting at a significantly reduced cost as compared with conventional casting techniques. The same concept can be applied to toll melt or realloy requirements in which scrap alloys can be refined by the AOD process with reactive elements being removed by that process. The same alloy (nickel, chromium, molybdenum, columbium and carbon) can then be thoroughly refined through the relatively inexpensive AOD process. The aluminum and titanium (reactives) can be reintroduced into the finished product by mechanically combining a small quantity of the vacuum refined nickel, aluminum and titanium alloy with the larger ingot of AOD refined material. Preferably, the mechanically joined component alloy quanitities are provided as a composite ingot, thereby ensuring an alloy of proper composition from the investment casting process.

In one broad aspect the present invention is a process for producing a quantity of metal alloy which includes no less than about 0.3% aluminum, no less than about 0.1% titanium, and no greater than about 12% aluminum and titanium in the aggregate. The process comprises forming a first ingot containing all of the aluminum and titanium for the alloy in a nickel matrix by vacuum melting. A second air-melting grade ingot is then formed by the AOD process and contains all the other nonreactive elements required to produce the desired alloy. The first and second ingots are then mechanically joined together, such as by welding and are subsequently remelted to produce an investment casting having one specified chemistry.

The invention may also be applied to the metallurgical processing of alloys containing other reactive metals. For example, in another aspect the invention may be considered to be a process for producing a quantity of metal alloy which includes no more than about 15% in the aggregate of reactive elements selected from the group consisting of titanium, tantalum, zirconium, and hafnium. The process comprises forming a first metal ingot by vacuum-induction melting a first charge containing the entire amount of reactive elements in a cobalt matrix. A second metal ingot is formed from a second charge of air-melting grade material containing cobalt. The first and second ingots are mechanically joined together and are subsequently melted together by the investment caster.

In the processing of metal alloys containing aluminum and titanium the amount of nickel in the first ingot is preferably no less than the aggregate amount of aluminum and titanium therein. In the metallurgical processing of alloys containing reactive elements, the amount of cobalt in the first charge is at least equal to the aggregate amount of reactive elements therein. In the processing of alloys containing aluminun and titanium, the proportion of the aluminum to titanium in the alloy is preferably between about 1:11 and about 11:1. In the processing of metal alloys according to the invention containing reactive elements the reactive elements preferably do not exceed 15% of the total alloy material. Any single particular reactive element is typically present in a concentration of between 0.005% and 10%.

The invention may be described with greater clarity and particularity with reference to the following examples.

EXAMPLE 1

According to the invention, a quantity of a nickel based alloy for investment casting is produced. The total quantity of the material which is to be investment cast contains aluminum, titanium, and nickel including no less than about 0.3% aluminum, no less than about 0.1% titanium and no greater than about 12% aluminum and titanium in the aggregate.

According to the invention, a first metal ingot is formed containing the entire amount of aluminum and titanium and an amount of nickel approximately equal to the total amount of aluminum and titanium. The first ingot is formed by vacuum-induction melting. The ratio of alumium to titanium may vary between 1:11 and 11:1. One typical composition of elemental concentrations in the material in the first ingot is set forth below in Table 1.

TABLE 1

| Element (wt. %) | Minimum | Maximum | Preferred |
|---|---|---|---|
| C | | .05 | .06 |
| Zr | .50 | .70 | .60 |
| Al | 38.00 | 42.00 | 40.00 |
| Ti | 5.80 | 6.50 | 6.00 |
| Ni | BAL | BAL | BAL |
| Oxygen | | 200 ppm | LAP |
| Nitrogen | | 200 ppm | LAP |
| Sn | | 20 ppm | LAP |
| Pb | | 20 ppm | LAP |

The material having a composition as set forth in Table 1 must be melted in a zirconia crucible. In Table 1, and the following tables, several abbreviations are employed. These are: BAL for balance; LAP for as low as possible; and ppm for parts per million.

A second air-melting grade ingot containing nickel is also formed. The elemental composition of a typical exemplary material used to form the second ingot is set forth in Table 2.

TABLE 2

| Element (wt. %) | Minimum | Maximum | Preferred |
|---|---|---|---|
| C | .10 | .15 | .13 |
| Si | LAP | .20 | LAP |
| Mn | LAP | .20 | LAP |
| Cr | 16.00 | 16.50 | 16.20 |
| Mo | 4.50 | 5.20 | 5.00 |
| Cb | 2.20 | 2.70 | 2.60 |
| B | .008 | .015 | .012 |
| Fe | LAP | .50 | LAP |
| Ni | BAL | BAL | BAL |
| Cu | LAP | .20 | LAP |
| W | LAP | .20 | LAP |
| Co | LAP | 1.00 | LAP |
| Pb | LAP | 10 ppm | LAP |
| Ag | LAP | 10 ppm | LAP |
| Sn | LAP | 10 ppm | LAP |
| Bi | LAP | .5 ppm | LAP |
| Oxygen | LAP | 50 ppm | LAP |
| Nitrogen | LAP | 50 ppm | LAP |

The second ingot may be formed by either air casting, AOD, or some other method of producing an air-melting grade material.

The first and second ingots are then mechanically joined together. THe first ingot represents only 15% of the combined weight of the two ingots, while the weight of the second ingot represents 85% of the combined weight.

The two ingots remain mechanically joined together until they are required to produce an investment cast part. Table 3 sets forth the elemental concentration of the composite material which is to be investment cast when the two ingots are joined into one ingot and are melted. The column of ranges in weight percentages indicates the preferred range of weights of the several elements in the total mass to be investment cast. The column of preferred weights indicates the preferred percentage by weight of each element within the possible range of weight concentrations. The column under the first ingot designation, which comprises 15% weight of the composite material, specifies the preferred percentage of elements in the first ingot. The column for the second ingot, which forms 85% of the weight of the composite mass, indicates the percentage concentration by weight of elements in the second ingot. The column for the composite material represents the elemental concentration in the aggregate mass of material to be investment cast. The elemental concentrations achieved in producing the composite material meets the AHS-5391 industry specification, which heretofor has been met only by alloys formed by vacuum-induction melting.

TABLE 3

| RANGES | (Wt. %) | PREFERRED CONCENTRATION | SECOND INGOT 85% | FIRST INGOT 15% | COMPOSITE 100% |
|---|---|---|---|---|---|
| Al | 5.50–6.50 | 6.00 | | 40.00 | 6.00 |
| B | .005–.015 | .010 | .012 | | .010 |
| C | .08–.20 | .12 | .13 | | .11 |
| Cb | 1.80–2.80 | 2.20 | 2.60 | | 2.21 |
| Co | 1.00X | LAP | | | LAP |
| Cr | 12.0–14.0 | 13.8 | 16.20 | | 13.77 |
| Cu | .20X | LAP | | | LAP |
| Fe | 2.50X | LAP | | | LAP |
| Mn | .25X | LAP | | | LAP |

TABLE 3-continued

| RANGES | (Wt. %) | PREFERRED CONCENTRATION | SECOND INGOT 85% | FIRST INGOT 15% | COMPOSITE 100% |
|---|---|---|---|---|---|
| Mo | 3.8–5.2 | 4.25 | 5.00 | | 4.25 |
| Ni | 74.00 | 74.0 | 77.30 | 53.40 | 73.70 |
| P | .015X | LAP | | | LAP |
| S | .015 | LAP | | | LAP |
| Si | .50X | LAP | | | LAP |
| Ti | .50–1.00 | .90 | | 6.00 | .90 |
| Zr | .05–.15 | .09 | | .60 | .09 |

EXAMPLE 2

The method of the invention is not limited to nickel based alloys. The metallurgical procedure of the invention may also be applied to similar families of metal alloys, such as cobalt alloys. Cobalt alloys contain little or no aluminum or titanium.

Typically in cobalt based alloys certain reactive element additives are employed to strengthen the metal alloy. For example, zirconium and titanium may be added, as these elements are beneficial for strengthening the alloy. Other reactive elements may be employed in small concentrations to achieve other desirable properties in the metal alloy.

According to the practice of the invention in connection with the production of cobalt based alloys, a first ingot is formed by vacuum-inducting melting a first charge containing the entire amount of reactive elements in a cobalt matrix. Specifications for a typical elemental concentration of the frist metal ingot are set forth in Table 4.

TABLE 4

| Element (wt. %) | Minimum | Maximum | Preferred |
|---|---|---|---|
| C | .03 | .06 | .05 |
| Ti | 1.90 | 2.20 | 2.0 |
| 2r | 4.90 | 5.20 | 5.0 |
| Ta | 34.00 | 36.00 | 35.0 |
| Co | BAL | | BAL |
| Oxygen | LAP | 200 ppm | LAP |
| Nitrogen | LAP | 200 ppm | LAP |
| Sn | LAP | 20 ppm | LAP |
| Pb | LAP | 20 ppm | LAP |

A second charge of air-melting grade material containing cobalt is also produced in a zirconia crucible. Specifications for a typical elemental concentration of the second charge are set forth in Table 5.

TABLE 5

| | MATRIX INGOT | | |
|---|---|---|---|
| Element (wt. %) | Minimum | Maximum | PREFERRED |
| C | .60 | .70 | .66 |
| Co | BAL | — | BAL |
| Cr | 26.0 | 27.0 | 26.6 |
| Fe | LAP | 1.5x | 1.5x |
| Mn | LAP | .10x | .10x |
| Ni | 10.5 | 11.5 | 11.0 |
| P | LAP | .015x | .015x |
| S | LAP | .015x | .015x |
| Si | LAP | .40x | .40x |
| B | LAP | .010x | .010x |
| W | 7.20 | 8.20 | 7.77 |
| Pb | LAP | 10 ppm | LAP |
| Ag | LAP | 10 ppm | LAP |
| Sn | LAP | 10 ppm | LAP |
| Bi | LAP | .5 ppm | LAP |
| Oxygen | LAP | 50 ppm | LAP |
| Nitrogen | LAP | 50 ppm | LAP |

Table 6 sets forth the elemental composition of the mechanically combined materials which form an alloy for investment casting. The range column in Table 6 indicates preferred ranges of weight concentrations for the several elements in the final product. The adjacent column indicates the preferred elemental concentration within the range of the first column. The preferred weight concentrations of the first ingot, which represents 10% of the aggregate weight of the combined ingots, are set forth in the next adjacent column. Similarly, the preferred weight concentrations of the second ingot, which represents 90% of the aggregate weight of the combined ingots, likewise sets forth preferred weight concentrations of elements. The final column, representing the entire 100% weight of the mechanically combined ingots contains the final elemental concentration achieved when the first and second ingots are joined together into one ingot and remelted. An alloy having the weight concentrations set forth in the composite column of Table 6 meets the PWA-647F industry specification. This specification has previously been met only by utilizing metal alloys processed entirely by vacuum-induction melting.

TABLE 6

| RANGES | (wt. %) | PREFERRED CONCENTRATION | SECOND INGOT 90% | FIRST INGOT 10% | COMPOSITE 100% |
|---|---|---|---|---|---|
| B | .010x | LAP | | | .010x |
| C | .55–.65 | .60 | .66 | | .60 |
| Co | BAL | BAL | BAL | BAL | AL |
| Cr | 22.50–24.24 | 24.00 | 26.6 | | 23.94 |
| W | 6.5–7.5 | 7.0 | 7.77 | | 7.0 |
| Fe | 1.50x | LAP | LAP | | 1.5x |
| Mn | .10x | LAP | LAP | | .10x |
| Ni | 9.0–11.0 | 10.0 | 11.0 | | 9.90 |
| P | .015x | LAP | LAP | | .015x |
| S | .015x | LAP | LAP | | .015x |
| Si | .40x | LAP | LAP | | .40x |
| Ti | .15–.30 | .20 | — | 2.0 | .20 |
| Zr | .30–.60 | .50 | — | 5.0 | .50 |
| Ta | 3.0–4.0 | 3.5 | — | 35.0 | 3.50 |

By employing the metallurgical process of the invention, great savings can be achieved in producing alloys suitable for use in investment casting of superalloy components. Only a small portion of the material used in casting the final part must be produced by the expensive vacuum-induction melting process. The balance can be produced from far cheaper air-melting grade materials.

Undoubtedly, numerous variations and modifications of the invention will become readily apparent to those familiar with high-grade metallurgical processing of alloys. Accordingly, the scope of the invention should not be construed as limited to the specific examples set forth herein but rather is defined in the claims appended hereto.

I claim:

1. A method of producing a quantity of a nickel based alloy for investment casting containing aluminum, titanium and nickel including no less than about 0.3% aluminum, no less than about 0.1% titanium and no greater than about 12% aluminum and titanium in the aggregate, the said method comprising forming a first metal ingot containing the entire amount of aluminum and titanium in a nickel matrix by vacuum melting, forming a second air-melting grade ingot containing nickel, and mechanically joining said first and second ingots together by welding to produce an investment casting charge.

2. The method of claim 1 further characterized in that the proportion of aluminum to titanium is between about 1:11 and 11:1.

3. The method of claim 1 further comprising forming said second ingot by argon oxygen decarburization.

4. The method of claim 1 further comprising forming said first ingot by vacuum-induction melting.

5. A process for producing a quantity of metal alloy which includes no less than about 0.3% aluminum, no less than about 0.1% titanium, and no greater than about 12% aluminum and titanium in the aggregate comprising: forming a first metal ingot containing all of the aluminum and titanium for said alloy in a nickel matrix by vacuum melting, forming a second metal ingot of air-melting grade material and containing nickel, and mechanically joining said first and second ingots together.

6. A process according to claim 5 wherein the amount of nickel in said first ingot is no less than the aggregate amount of aluminum and titanium therein.

7. A process according to claim 5 wherein the proportion of aluminum to titanium in said alloy is between about 1:11 and about 11:1.

8. The method of claim 5 further comprising forming said second ingot by argon oxygen decarburization.

9. The method of claim 5 further comprising forming said first ingot by vacuum induction melting.

10. A process for producing a quantity of metal alloy which includes no more than about 15% in the aggregate of reactive elements selected from the group consisting of titanium, tantalum, zirconium, and hafnium, comprising forming a first metal ingot by vacuum-induction melting a first charge containing the entire amount of reactive elements in a cobalt matrix, forming a second metal ingot from a second charge of air melting grade material containing cobalt, and mechanically joining said first and second ingots together by welding.

11. The method of claim 10 further comprising forming said second ingot by argon oxygen decarburization.

12. The method of claim 10 further comprising forming said first ingot by vacuum induction melting.

13. The method of claim 10 wherein the amount of cobalt in said first charge is no less than the aggregate of reactive elements therein.

* * * * *